US008101113B2

(12) United States Patent
Castonguay et al.

(10) Patent No.: US 8,101,113 B2
(45) Date of Patent: Jan. 24, 2012

(54) MOLDING APPARATUS FOR PRODUCING DRY CAST PRODUCTS HAVING TEXTURED SIDE SURFACES

(75) Inventors: Bertin Castonguay, Magog (CA); Marcel Thomassen, L'Épiphanie (CA); Robert Daoust, Boucherville (CA); Marc-André Lacas, Laval (CA)

(73) Assignee: Oldcastle Building Products Canada, Inc. (CA)

( * ) Notice: Subject to any disclaimer, the term of this patent is extended or adjusted under 35 U.S.C. 154(b) by 717 days.

(21) Appl. No.: 11/379,462

(22) Filed: Apr. 20, 2006

(65) Prior Publication Data

US 2006/0249881 A1 Nov. 9, 2006

Related U.S. Application Data

(60) Provisional application No. 60/673,344, filed on Apr. 21, 2005.

(51) Int. Cl.
*B28B 3/00* (2006.01)
*B28B 7/24* (2006.01)

(52) U.S. Cl. ..... 264/333; 249/104; 249/119; 249/140; 249/160; 249/203; 52/612

(58) Field of Classification Search ..... 249/102–104, 249/117, 119, 129, 114.1, 112, 113, 160, 249/140, 132, 203; 52/267–268, 596, 603, 52/604, 612; 425/385, 403; 264/333–334
See application file for complete search history.

(56) References Cited

U.S. PATENT DOCUMENTS

| | | | | |
|---|---|---|---|---|
| D27,761 | S | 10/1897 | Mark | |
| 803,014 | A * | 10/1905 | McIlravy | 249/64 |
| 2,339,489 | A | 1/1944 | Kublanow | |
| 2,629,135 | A * | 2/1953 | Johnson | 264/426 |
| 2,924,963 | A | 2/1960 | Taylor et al. | |
| 2,938,376 | A | 5/1960 | Workman et al. | |
| 2,964,800 | A | 12/1960 | Dorsett | |
| 3,231,646 | A | 1/1966 | Conder et al. | |
| 3,238,589 | A | 3/1966 | McClarney | |
| 3,267,823 | A | 8/1966 | MacRae | |
| 3,350,827 | A | 11/1967 | Sugar | |
| 3,380,215 | A | 4/1968 | Schaefer et al. | |

(Continued)

FOREIGN PATENT DOCUMENTS

BE 742 832 A 5/1970

(Continued)

OTHER PUBLICATIONS

Translation of JP 2001-191314 A1, pp. 1-7.*

(Continued)

*Primary Examiner* — Joseph Del Sole
*Assistant Examiner* — Dimple Bodawala
(74) *Attorney, Agent, or Firm* — Kilpatrick Townsend & Stockton LLP

(57) ABSTRACT

An apparatus for molding dry cast products having a textured side surface is disclosed. The apparatus comprises an open compartment for receiving a dry concrete mixture and a plurality of walls laterally enclosing the compartment. At least one of the walls has a multilevel surface with a plurality of sections in an overhanging relationship with each other and transitional curvilinear steps bridging adjacent one of the sections to impart a textured side surface resembling a natural rockface and allowing stripping of the dry cast products from an open bottom side of the compartment.

10 Claims, 10 Drawing Sheets

U.S. PATENT DOCUMENTS

| | | | | |
|---|---|---|---|---|
| 3,435,577 | A | | 4/1969 | O'Leary |
| 3,484,514 | A | | 12/1969 | Longinotti |
| 3,496,694 | A | | 2/1970 | Hicks et al. |
| 3,521,418 | A | | 7/1970 | Bartoloni |
| 3,602,476 | A | | 8/1971 | Iragorri |
| 3,712,825 | A | | 1/1973 | Yocum |
| 3,868,801 | A | | 3/1975 | Weiner |
| 3,870,423 | A | | 3/1975 | Peitz |
| 3,873,225 | A | | 3/1975 | Jakobsen et al. |
| 3,884,737 | A | | 5/1975 | Bransford, Jr. |
| 3,908,326 | A | | 9/1975 | Francis |
| 3,947,192 | A | | 3/1976 | Rosenberger |
| 4,044,520 | A | | 8/1977 | Barrows |
| 4,185,939 | A | | 1/1980 | Barth et al. |
| 4,335,549 | A | | 6/1982 | Dean, Jr. |
| 4,399,643 | A | | 8/1983 | Hafner |
| 4,433,518 | A | | 2/1984 | Rice |
| 4,510,729 | A | | 4/1985 | Syring |
| D278,935 | S | | 5/1985 | Scheiwiller |
| D282,288 | S | | 1/1986 | Bates |
| 4,574,536 | A | | 3/1986 | Bamber et al. |
| D283,551 | S | | 4/1986 | Repasky |
| 4,589,241 | A | | 5/1986 | Volpenhein |
| 4,656,722 | A | | 4/1987 | Armstrong |
| 4,752,520 | A | | 6/1988 | Franklin |
| 4,761,095 | A | | 8/1988 | Bartlechner |
| 4,788,808 | A | | 12/1988 | Slocum |
| 4,858,410 | A | | 8/1989 | Goldman |
| 4,869,660 | A | * | 9/1989 | Ruckstuhl ..... 425/195 |
| 4,956,949 | A | | 9/1990 | Francis |
| 4,987,712 | A | | 1/1991 | Mancuso |
| 5,009,387 | A | | 4/1991 | Scott et al. |
| 5,078,940 | A | | 1/1992 | Sayles |
| 5,173,233 | A | | 12/1992 | Kafarowski |
| 5,217,630 | A | * | 6/1993 | Sayles ..... 249/52 |
| 5,228,937 | A | | 7/1993 | Passeno |
| 5,232,608 | A | | 8/1993 | Mayer |
| 5,232,646 | A | | 8/1993 | Nasvik et al. |
| 5,268,137 | A | | 12/1993 | Scott et al. |
| 5,286,139 | A | | 2/1994 | Hair |
| 5,342,142 | A | | 8/1994 | Barth et al. |
| 5,348,417 | A | | 9/1994 | Scheiwiller |
| 5,386,963 | A | | 2/1995 | Nasvik et al. |
| 5,459,938 | A | | 10/1995 | Knight et al. |
| 5,501,049 | A | | 3/1996 | Francis et al. |
| 5,526,630 | A | | 6/1996 | Francis et al. |
| RE35,380 | E | | 11/1996 | Rea et al. |
| 5,570,551 | A | | 11/1996 | Koc, Sr. et al. |
| D378,702 | S | | 4/1997 | Blomquist et al. |
| 5,625,990 | A | | 5/1997 | Hazlett |
| 5,632,922 | A | | 5/1997 | Nasvik et al. |
| 5,647,571 | A | * | 7/1997 | Hupp ..... 249/2 |
| 5,686,009 | A | * | 11/1997 | Gregersen ..... 249/120 |
| 5,713,155 | A | | 2/1998 | Prestele |
| D393,727 | S | | 4/1998 | Wiegand, Jr. |
| 5,836,572 | A | | 11/1998 | Sugiyama |
| 5,839,251 | A | | 11/1998 | Weinstein |
| 5,855,075 | A | | 1/1999 | DiGiovanni |
| 5,894,676 | A | | 4/1999 | DiGiovanni |
| 5,921,705 | A | | 7/1999 | Hodson et al. |
| 6,007,321 | A | * | 12/1999 | Meckel et al. ..... 425/432 |
| 6,041,567 | A | | 3/2000 | Passeno |
| 6,082,933 | A | | 7/2000 | Maguire et al. |
| 6,098,363 | A | | 8/2000 | Yaguchi |
| D431,870 | S | | 10/2000 | Ziegler, Jr. |
| D431,871 | S | | 10/2000 | Abbrancati |
| 6,159,401 | A | | 12/2000 | Hoesch |
| 6,164,037 | A | | 12/2000 | Passeno |
| D439,677 | S | | 3/2001 | Mattox |
| 6,209,848 | B1 | | 4/2001 | Bolles et al. |
| 6,355,193 | B1 | * | 3/2002 | Stott ..... 264/46.5 |
| 6,360,505 | B1 | | 3/2002 | Johns |
| 6,431,798 | B1 | | 8/2002 | Magliocco |
| 6,443,663 | B1 | | 9/2002 | Scales et al. |
| D477,091 | S | | 7/2003 | Manthei |
| D479,341 | S | | 9/2003 | Scullion et al. |
| 6,616,874 | B1 | | 9/2003 | Lazar |
| 6,634,617 | B2 | | 10/2003 | Potvin |
| D488,568 | S | | 4/2004 | MacDonald |
| D491,675 | S | | 6/2004 | Ogawa et al. |
| 6,773,642 | B1 | * | 8/2004 | Wardell ..... 264/71 |
| 6,780,369 | B1 | | 8/2004 | Darrow et al. |
| 6,857,248 | B2 | | 2/2005 | Ouellet et al. |
| 6,871,468 | B2 | | 3/2005 | Whitson |
| D505,733 | S | | 5/2005 | Castonguay et al. |
| 6,990,778 | B2 | | 1/2006 | Passeno |
| D539,927 | S | | 4/2007 | Whitson |
| D540,954 | S | | 4/2007 | Bouchard |
| 7,208,112 | B2 | * | 4/2007 | Scherer ..... 264/219 |
| 7,267,321 | B1 | * | 9/2007 | Morrell ..... 249/102 |
| D552,258 | S | | 10/2007 | Strand et al. |
| D555,810 | S | | 11/2007 | Strand |
| D557,428 | S | | 12/2007 | Doman |
| D578,224 | S | | 10/2008 | Lacas |
| D579,576 | S | | 10/2008 | Lacas |
| D584,834 | S | | 1/2009 | Lacas |
| 7,618,578 | B2 | * | 11/2009 | Manthei et al. ..... 264/334 |
| 7,687,006 | B2 | * | 3/2010 | Manthei et al. ..... 264/334 |
| 2003/0126821 | A1 | | 7/2003 | Scherer et al. |
| 2003/0164574 | A1 | | 9/2003 | Hamer et al. |
| 2003/0182011 | A1 | | 9/2003 | Scherer |
| 2004/0091317 | A1 | | 5/2004 | Shouldice |
| 2004/0098938 | A1 | | 5/2004 | Nordstrand |
| 2004/0104511 | A1 | | 6/2004 | Griffith |
| 2004/0191461 | A1 | | 9/2004 | Riccobene |
| 2004/0227053 | A1 | * | 11/2004 | Manthei ..... 249/83 |
| 2005/0028476 | A1 | | 2/2005 | Bouchard et al. |
| 2005/0108973 | A1 | * | 5/2005 | Hammer et al. ..... 52/596 |
| 2005/0136148 | A1 | * | 6/2005 | Martin ..... 425/458 |
| 2007/0193176 | A1 | | 8/2007 | Bouchard et al. |
| 2009/0000233 | A1 | * | 1/2009 | Hammer ..... 52/596 |
| 2009/0103987 | A1 | * | 4/2009 | MacDonald ..... 405/284 |

FOREIGN PATENT DOCUMENTS

| | | | | |
|---|---|---|---|---|
| CA | 0909538 | | | 9/1972 |
| DE | 37 33 707 | A1 | | 4/1989 |
| DE | 100 50 908 | A1 | | 4/2002 |
| EP | 0088198 | | | 9/1983 |
| EP | 0236585 | | | 9/1987 |
| EP | 0262712 | | | 4/1988 |
| FR | 2583808 | | | 12/1986 |
| GB | 2111550 | | | 7/1983 |
| GB | 2280690 | | | 2/1995 |
| JP | 04070305 | A | * | 3/1992 |
| JP | 06071630 | A | * | 3/1994 |
| JP | 2001191314 | A | * | 7/2001 |
| JP | 2002/285504 | | | 10/2002 |
| WO | WO 8807920 | A1 | * | 10/1988 |
| WO | WO 9322527 | | | 11/1993 |

OTHER PUBLICATIONS

Correspondence from Qualey Law Office, LLC.

* cited by examiner

MOLDING APPARATUS FOR PRODUCING DRY CAST PRODUCTS HAVING TEXTURED SIDE SURFACES

CROSS-REFERENCE TO RELATED APPLICATIONS

This application is related to and claims priority benefits from U.S. Provisional Patent Application Ser. No. 60/673,344, filed Apr. 21, 2005.

FIELD OF THE INVENTION

The present invention relates generally to the field of molding apparatuses for producing dry cast products, such as dry cast stones, edgers, retaining walls, pavers, etc., and a method thereof. More particularly, it concerns a molding apparatus for manufacturing dry cast concrete products having textured side surfaces and the method thereof.

BACKGROUND OF THE INVENTION

Throughout the description, the expression "stone" is used to designate any dry cast masonry or dry cast landscaping products such as artificial stones, pavers, edgers, retaining walls, etc. Therefore, the use of the expression "stone" should not be given a restrictive meaning, as it intends to designate a variety of dry cast products.

It is known in the art that artificial products, such as pavers, low walls, etc., may be produced from two widely used casting processes: a wet cast molding process and a dry cast molding process. Using the wet cast molding process, it is possible to produce stones having textures on one or many of their surfaces, thereby giving a more antique and/or natural appearance to the stones. It is worth mentioning that in the field of pavers and stones, the expression "natural" refers to the quality of a surface which has the same properties and or the same geometry as a natural stone found in nature or cut by artificial means such as a splitter in a quarry or the various tools used by a stone cutter or mason; whereas the expression "antique" refers to the wear that is visible on a surface that was weathered by the passage of time. The wear can be caused by the actual aging of a product or by artificial means.

One way to capture the imprint of the natural stone to produce such artificial stones consists in obtaining a mold of one or more natural stones by pouring a resin/fiber material, such as polyurethane, over the natural stone so as to solidify the same in the shape of the stone. Another way to produce such artificial stones consists in scanning a surface of one or more natural stones, and producing molds from the numerical scans. Once the molds are obtained, a wet concrete mixture is poured into the molds and left to dry. After a predetermined period of time, when the concrete mixture is dried, the molds are stripped off from the formed wet cast stones. As previously mentioned, the molds may have textured inner surfaces similar to the surfaces of natural stones for imprinting a texture on top, bottom and/or side surfaces of the wet cast stones. One drawback of using the wet cast molding process to produce stones having an antique look on their top and side surfaces, is that the process is time consuming and costly. Generally speaking, wet cast processes also require longer manufacturing times, and therefore a lower productivity, due to the drying and demolding times, which are considerably longer than comparable dry cast processes.

Dry cast molding, in comparison, offers a number of advantages over wet cast molding. Typically, a dry concrete mixture is poured into individual compartments of a molding frame. The frame resembles a large tray with holes punched through it, with each hole being a compartment. In use, the frame is placed on a plate, creating a temporary bottom to the compartment. Tamper-shoes are used for compacting dry concrete mixture within the individual compartments. Once compacted, the frame is raised relative to the tamper shoes and plate, disengaging the compacted concrete mixture. This vertical de-molding operation is also called stripping. The concrete stones are then transferred to another area for further processing.

The shape of the individual compartments can be designed in a wide range of patterns in accordance with the desired shape of the dry cast stones to be formed. The tamper shoes may be provided with various textured patterns on their surfaces to imprint the same onto the top surfaces of the dry cast stones upon compaction of the dry concrete mixture. These textured patterns can be used to create an antique and/or natural appearance to the top surface of the dry cast stones.

Creating such textures on the sides of dry cast stones, however, is somewhat more difficult. Usually, the individual compartments used for compaction are delimited by flat inner side walls. Therefore, the resulting stones have flat side surfaces having no texture, thus yielding an artificial appearance. Stones having laterally projecting elements, such as interlocking tongues and grooves, can be created in molds with corresponding sliding panels which retract within the mold to allow stripping. The inner walls of the individual compartments may also be designed with vertical recesses or protrusions carved or embossed into the flat surfaces of the inner walls so as to create spacers or interlocking devices on the sides of the dry cast stones. Such designs are limited by the nature of the stripping operation, which is preferably done very quickly once the compacting operation is completed.

Of course, it is also possible to demold the dry cast stones from the molding frame by retracting the inner walls altogether before proceeding with the vertical relative motion between the molding frame and the stones. In that case, the surfaces of the movable inner walls may be provided with natural looking textures (irregular, uneven surfaces). However, implementing retractable inner walls is very complex and costly. It is therefore avoided when possible.

The following US patents disclose prior art techniques developed for manufacturing dry cast products with textured side walls.

U.S. Pat. No. 5,078,940, issued Jan. 7, 1992 to Sayles, describes a mold for making a concrete block having a roughened texture on one side. A set of projections and a reinforcing mesh along an inner wall of the mold are provided to retain a portion of the mold material inside the mold during stripping, thereby shearing off that portion during stripping and creating a fractured, roughened texture on one side.

U.S. Pat. No. 6,209,848, issued Apr. 3, 2001 to Bolles et al., describes another mold for making a concrete block having a roughened texture wherein an inwardly facing lip is provided along the lower edge of one of the walls. As the block is removed from the mold, the lower lip acts to scrape the mold material, thereby leaving a roughened surface. Similarly, U.S. patent application Ser. No. 10/091,039, published as 2003/0164574 on Sep. 4, 2003, describes a mold for texturing a concrete block wherein an inner surface comprises projections extending into the mold cavity for scoring the block during stripping.

U.S. patent application Ser. No. 10/307,785, published as 2004/0104511 on Jun. 3, 2004, describes a mold for texturing a concrete block providing a mesh encircling one of the mold sidewalls. The mold material forms to the mesh during compaction, and is retained to the surface of the mesh during stripping. The mesh is operable to rotate around the wall as the block is demolded, thereby discharging a portion of the mold material and creating a roughened surface.

U.S. Pat. No. 4,761,095, issued Aug. 2, 1998 to Bartlechner, describes a paving stone having vertical ridges disposed along its lateral sides. These side surfaces are aimed at anchoring adjoining stones against lateral shifting and displacement.

However, while each of these techniques may aid in creating a non-uniform side surface, they also generally provide molds which score, mark or otherwise fracture a side of the compacted block. Therefore, and according to some people, the side surfaces obtained with these techniques often still have an artificial look.

As such, there exists a continued need for improved methods and apparatuses for producing dry cast masonry or landscaping products having textured side surfaces.

SUMMARY OF THE INVENTION

An object of the present invention is to provide an improved molding apparatus and a method thereof for producing dry cast stones having textured side surfaces.

According to the present invention, that object is achieved with a molding apparatus for molding dry cast products having a textured side surface, the apparatus comprising: an open compartment for receiving a dry concrete mixture and a plurality of walls laterally enclosing the compartment. At least one of the walls has a multilevel surface with a plurality of sections in an overhanging relationship with each other and transitional curvilinear steps bridging adjacent sections to impart a textured side surface resembling a natural rockface and allowing stripping of the dry cast products from an open bottom side of the compartment.

According to the present invention, there is further provided a molding method for molding dry cast stones having textured side surfaces. The method comprises the steps of: providing a molding apparatus as previously defined; pouring a dry concrete mixture within the compartment; compacting the dry concrete mixture against the plurality of walls laterally enclosing the compartment, thereby obtaining a dry cast product; and stripping the dry cast product through a vertical relative motion between the dry cast product and the compartment.

As can be appreciated, and thanks to the multilevel surface of the molding apparatus, the sidewalls of a product obtained with such apparatus have a natural stone appearance. Furthermore, and given the overhanging relationship between the different sections of the walls delimiting the individual compartments, the dry cast stones can be easily demolded without interference and consequently without scoring or scratching the side surfaces and that, without having to first retract the side walls delimiting the individual compartments.

The present invention also allows a wide range of multilevel surface patterns to be designed for producing dry cast stones having various textured side surfaces.

In brief, the present invention offers a molding apparatus able to impart a predetermined and reproducible natural-looking texture or pattern resembling a natural rockface to the side surface of a dry cast block while enabling a vertical stripping.

In accordance with a preferred embodiment, the apparatus further comprises a tamper shoe for compacting the dry concrete mixture received in the compartment, the tamper shoe having a contour matching a non-linear top contour of the open compartment. More preferably, the tamper shoe has a textured bottom face for imparting a textured top surface to the dry cast products.

In accordance with a further preferred embodiment, said at least one wall is divided in at least two vertical faces of different thicknesses spanning from top to bottom, each being provided with a respective one of said multilevel surfaces. The vertical faces are horizontally adjacent to each other and separated by steps extending generally in a vertical direction. Preferably, the steps have a multilevel surface as described above.

BRIEF DESCRIPTION OF THE DRAWINGS

Other objects and advantages of the invention will become apparent upon reading the detailed description and upon referring to the drawings in which.

DETAILED DESCRIPTION OF PREFERRED EMBODIMENTS

Figure 1:
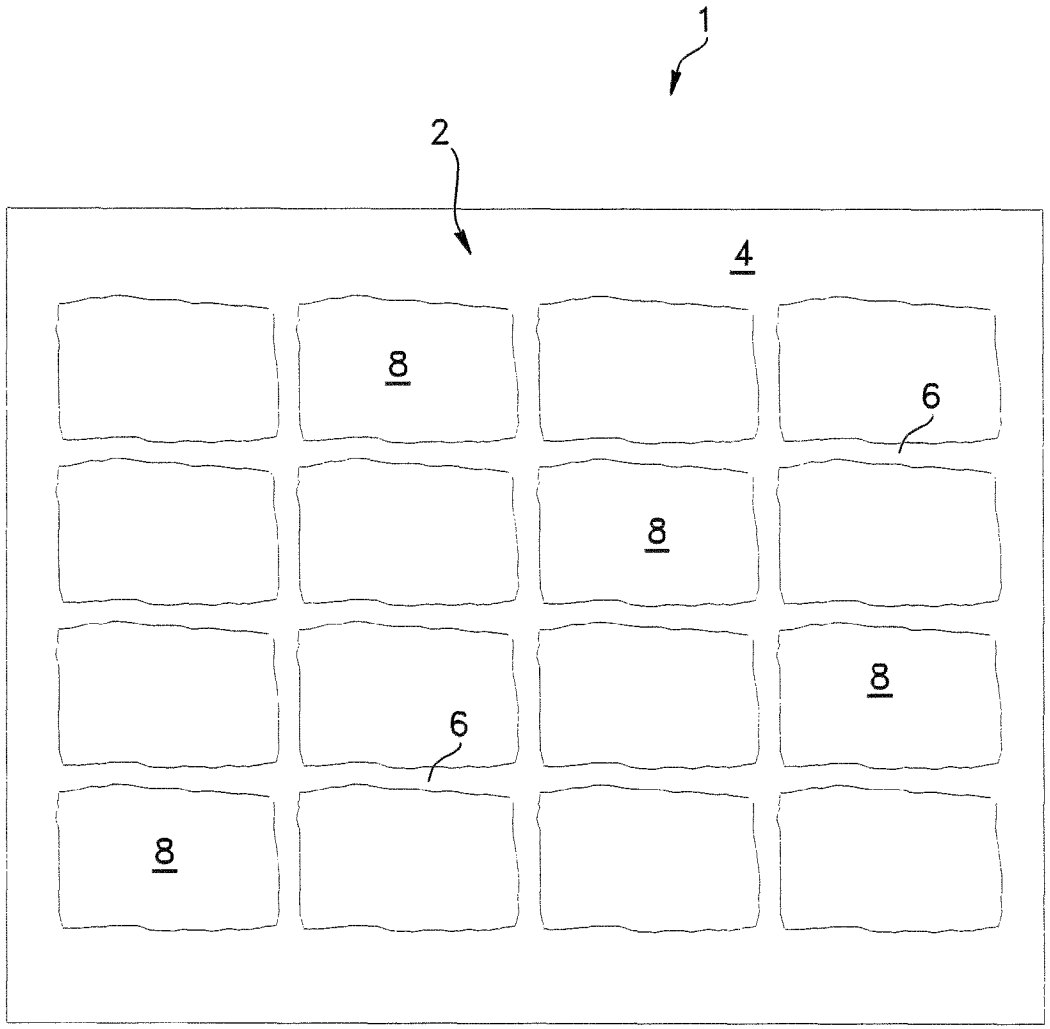
FIG. 1 is a schematic top view of a molding apparatus according to a preferred embodiment of the present invention.
Figure 2:
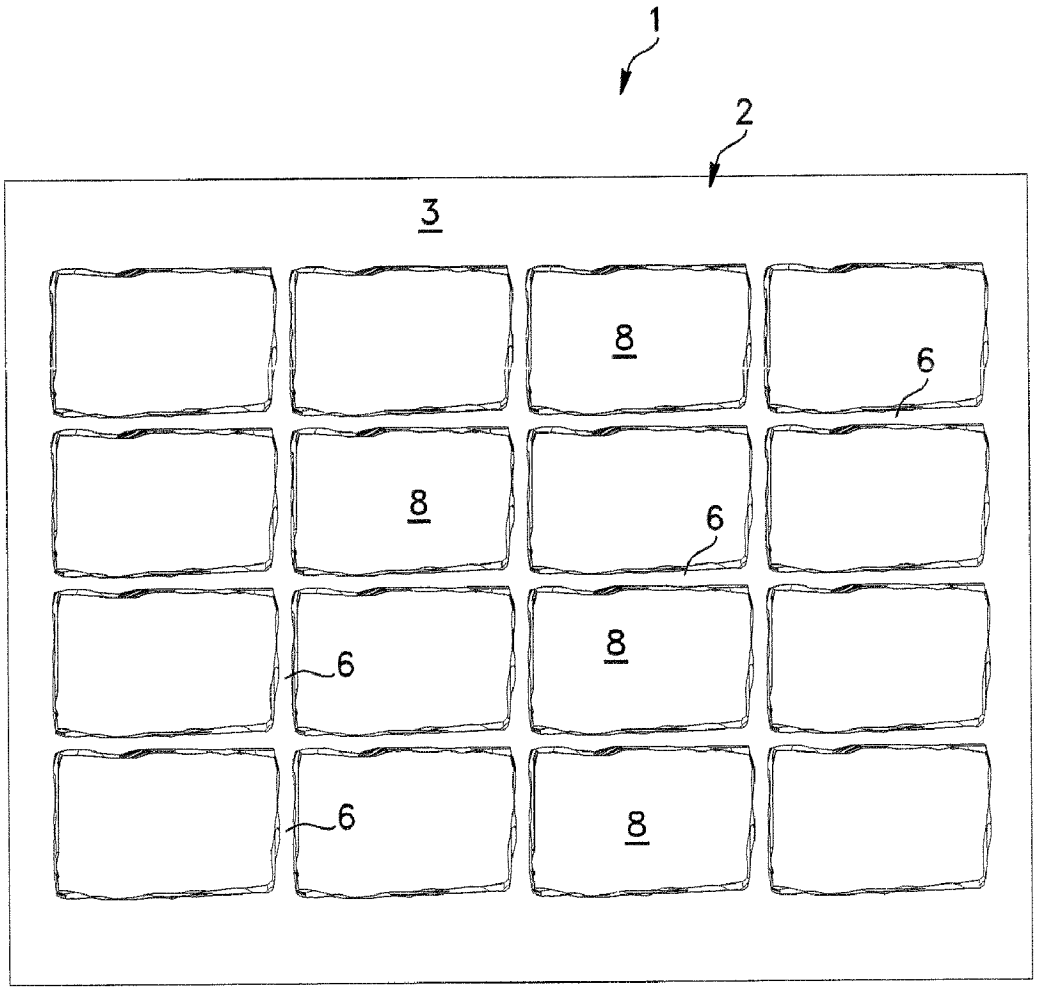
FIG. 2 is a bottom view of the molding apparatus of FIG. 1.
Figure 3:
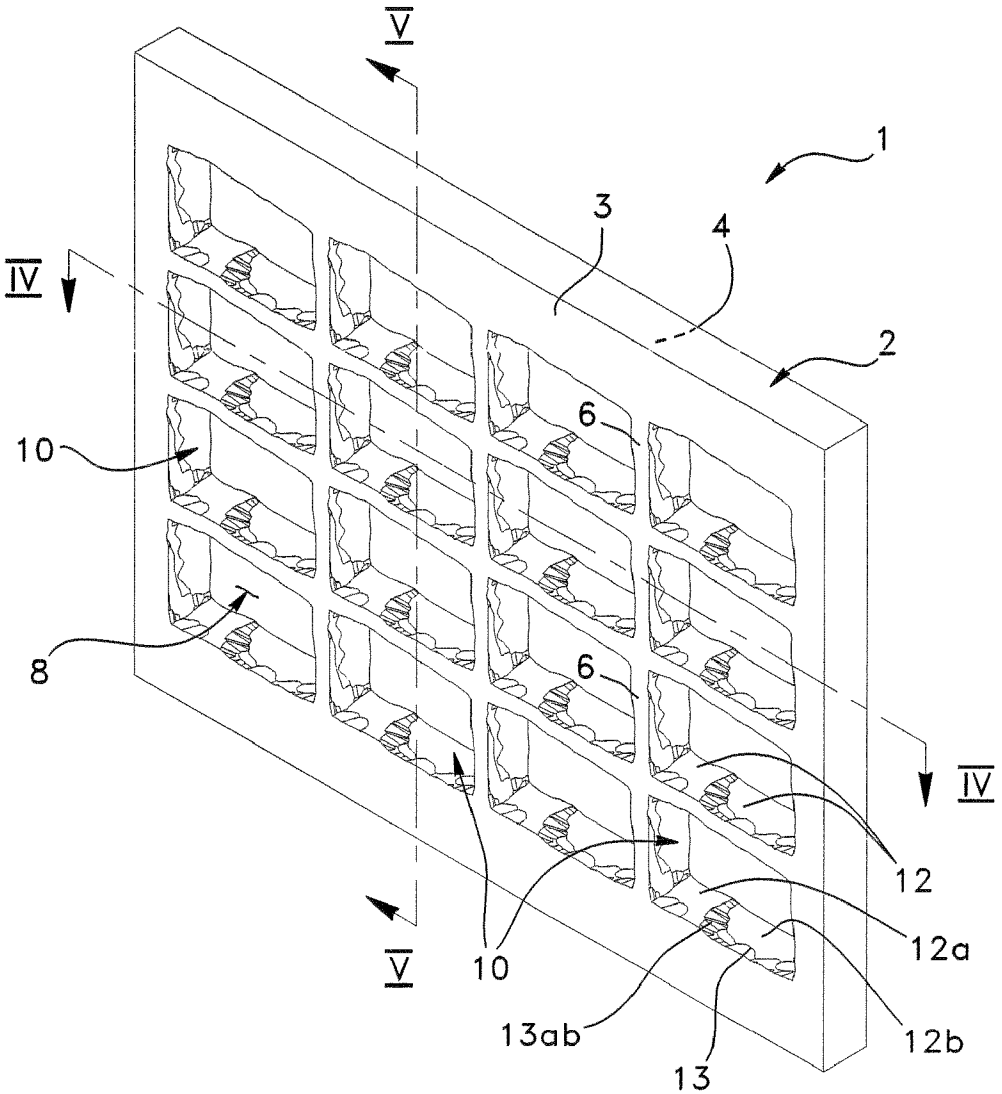
FIG. 3 is a perspective view of the molding apparatus of FIG. 1.
Figure 7:
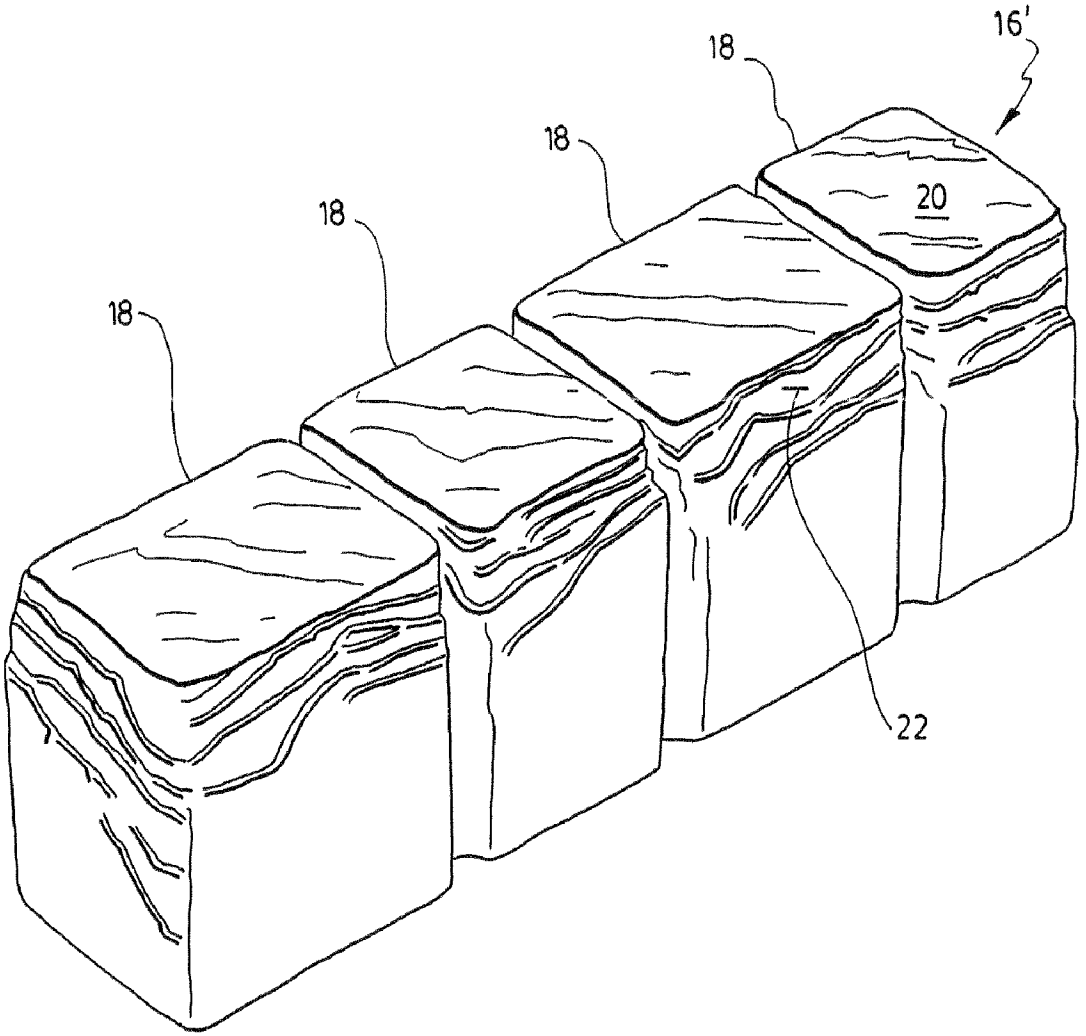
FIG. 7 schematically represents a perspective view of a dry cast stone obtained with a mold according to another preferred embodiment of the invention.
Figure 8:
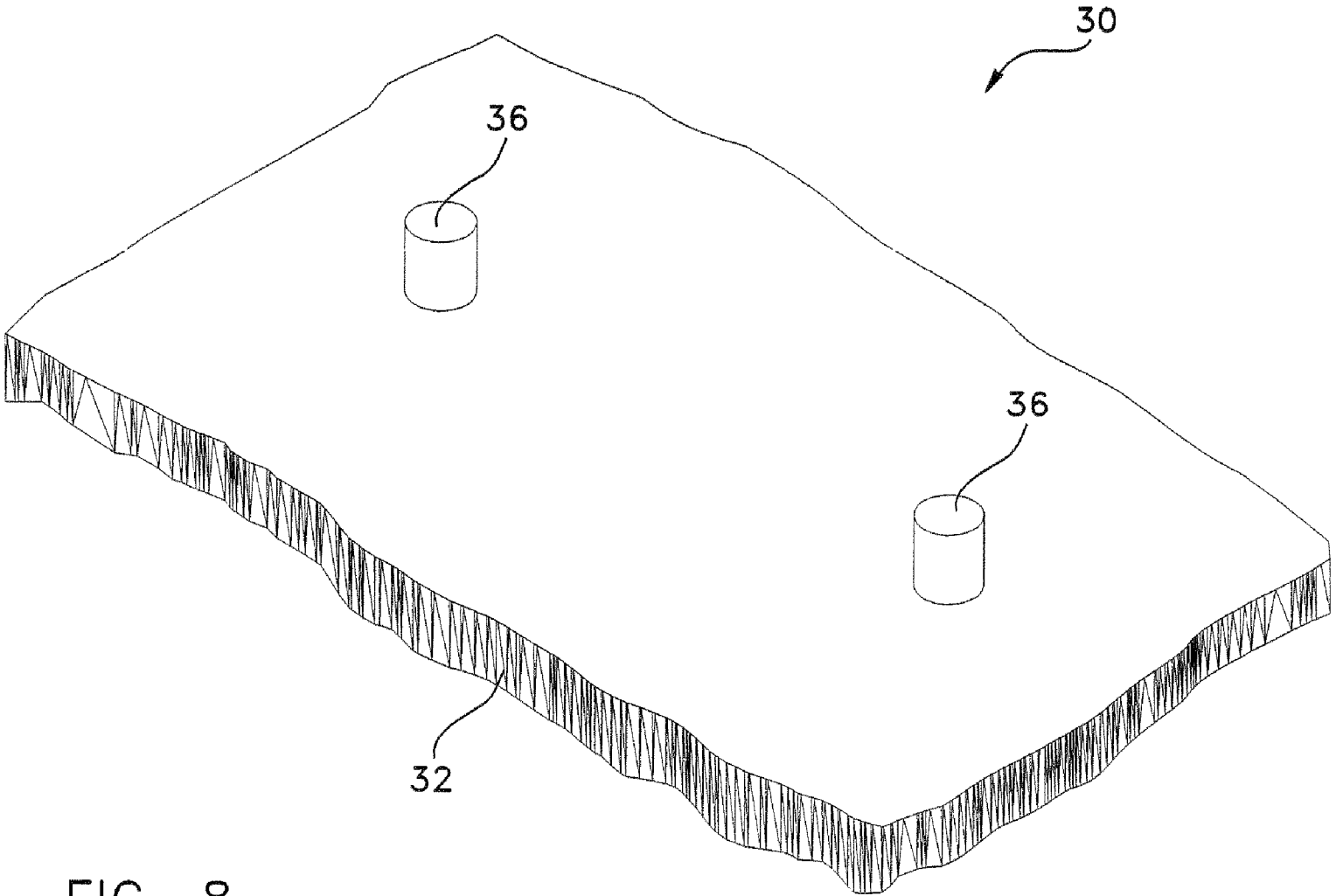
FIG. 8 is a top perspective view of a tamper shoe in accordance with a preferred mode of realization, for use with the molding apparatus shown in FIGS. 1 to 5.

Referring to FIGS. 1 to 3, there is shown a molding apparatus 1 according to a preferred embodiment of the invention. The molding apparatus 1 comprises a frame 2 with individual open molding compartments 8 for receiving a dry concrete mixture. The molding frame 2 has a top side 3 and a bottom side 4, and is adapted by means not shown, but well known to those of ordinary skill in the art, to be mounted in a machine for the dry-casting of concrete products, such as blocks or slabs. Side walls 6 (also referred to as partition walls) are laterally enclosing or forming the compartments 8. Once the compartments 8 are filled with the dry concrete mixture, tamper shoes 30 such as the one illustrated in FIG. 7 and 8 are used to compact the mixture within the compartments 8 and against the partition walls 6 as is well known in the art.

Illustrated herein, frame 2 comprises a plurality of compartments 8 in a grid arrangement. However, it is to be noted that frames 2 comprising a single compartment 8, or arranged in another fashion, are within the scope of the present invention. Furthermore, each compartment 8 is illustrated herein having a four-sided rectangular shape, although other shapes are well within the scope of the invention. The shape of compartment 8 can be, but is by no means limited to, a rectangle, a square, a triangle, an oval, a circle, or some combination thereof.

Each of the partition walls 6 has a multilevel surface 10 for imparting a texture to a side surface of a dry cast stone to be formed during compaction of the dry concrete mixture by the tamper shoe. Now referring also to FIGS. 4 and 5, the multilevel surface 10 comprises superimposed sections 12 in an overhanging relationship. This overhanging superimposition provides surface 10 with a generally tapering aspect that tapers from the top side 3 to bottom side 4. Each section 12 overhangs an adjacent section 12 that lies beneath. This superimposed tapering configuration of sections 12 enables the vertical stripping of the dry cast stones upon completion of the compacting operation.

The combination of sections 12 on surface 10 emulates the natural stratification of rock. Referring more particularly to the compartment identified with numeral reference 8*a* in FIG. 5, the multilevel surface 10 is shown comprising vertically disposed sections 12*a*, 12*b* and 12*c*. Section 12*a* overhangs section 12*b* which in turn overhangs section 12*c*. The thickness of side wall 6 is generally constant across any individual section, but greater at section 12*a* than at section 12*b*. Similarly, the thickness of wall 6 is greater at section 12*b* than at section 12*c*. In other words, the plurality of sections 12 always preferably comprises at least a top section 12*a* having a first thickness and comprising a top edge aligned with a top side 3 of the compartment 8 and a bottom section (referred to with numeral reference 12*c* in FIG. 5) vertically below the top section 12*a* and having a second thickness smaller that the first thickness. One or more intermediate sections 12*b* are also preferably provided vertically between the top section 12*a* and the bottom section 12*c*, each of the intermediate sections having a respective thickness which is smaller that the first thickness and greater than the second thickness, and the respective thickness of each of the plurality of intermediate sections, should there be more than one of said intermediate sections, decreasing from a topmost to a bottommost of said intermediate sections. The side walls 6 are thus tapering off from top to bottom. This generally tapering aspect is best seen by viewing the side walls 6 shown in cross section in FIGS. 4 and 5.

As can be appreciated, a vertical path traced from anywhere along top edge 3 to bottom edge 4 will traverse sections 12 of decreasing thicknesses. For example, vertical line 17, shown in FIG. 4, begins at top edge 3 on section 12*a*, crosses section 12*b*, and then section 12*c* to end at bottom edge 4.

It is to be noted, however, that while side walls 6 are illustrated as straight in FIGS. 1 and 2, other configurations are within the scope of the invention. Furthermore, the expression thickness used to describe side walls 6 relates to the relative nominal thicknesses of sections 12 of wall 6. In applications where wall 6 is incorporated in a larger structure, for example frame 2, the thicknesses of sections 12 on a given surface 10 are not necessarily to be measured from the opposing surface 10 if that wall itself is textured with a multilevel surface as well. In that case, an imaginary vertical datum can be established to compare thicknesses. Where wall 6 is curved, as is within the scope of the present invention, a similar imaginary curved datum can be established.

Figure 4:
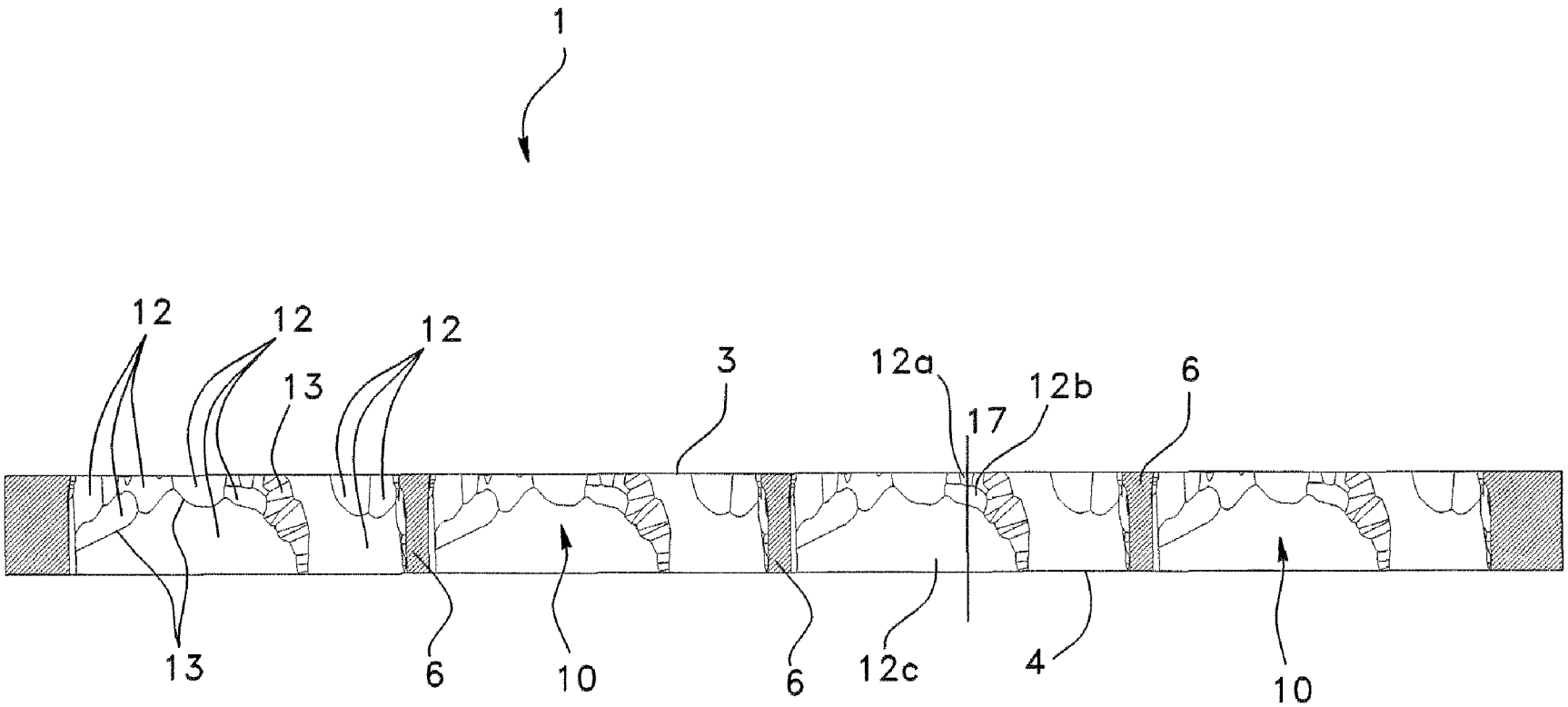
FIG. 4 is a cross section view along line IV-IV of the molding apparatus shown in FIG. 3.

As identified in FIGS. 3 and 4, between adjacent sections 12 are located transitional generally curvilinear steps 13 which define the curvilinear boundaries between sections 12 and serve to smooth the transition therebetween. It is this curvilinear aspect of sections 12 and transitional steps 13 which creates a textured side surface resembling the stratification of a natural rock face. Transitional curvilinear steps 13 are generally much smaller in surface area than sections 12. For example, in FIG. 3, transitional curvilinear step 13*ab* bridges the thicknesses of sections 12*a* and 12*b*, and, as such, slopes generally inward and downward. Transitional curvilinear steps 13 can be of constant slope, or be of varying slope, thereby providing a smoother transition.

Figure 5:
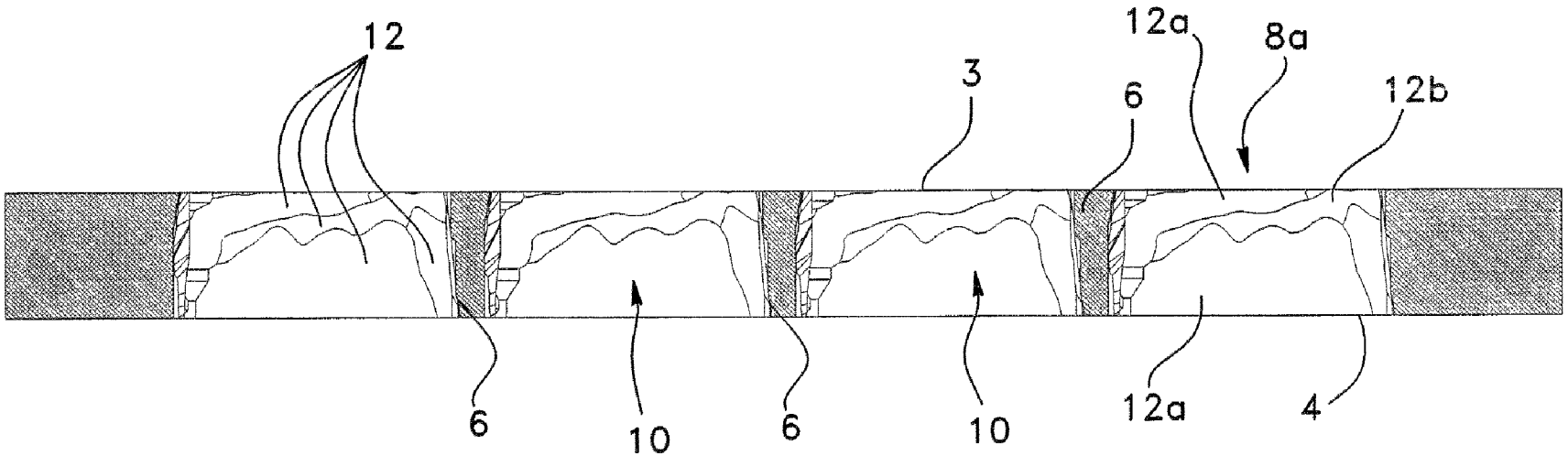
FIG. 5 is a cross section view along line V-V of the molding apparatus shown in FIG. 3.

As best shown in FIGS. 4 and 5, some of these transitional curvilinear steps 13 follow a line that curves downwards, thereby providing horizontally adjacent ones of said sections having different thicknesses. Some of the lines die at the bottom side 4.

When arranged in a molding frame 2, this arrangement of sections 12 creates a surface 10 which imparts a texture to a molding material therewithin, without impeding stripping.

Because sections 12 taper from top to bottom, that is to say the average horizontal cross-sectional area of compartments 8 increases from top to bottom, there is no interference between the multilevel surfaces 10 and the side surfaces of dry cast stones during vertical stripping. As previously described, for the stripping phase, the formed stones are disengaged from the molding compartments 8 through a downward motion of the formed stones relative to the molding frame 2. An analogy can be drawn between the disengagement of the formed stone and the stripping of compacted sand out of a sand bucket.

Figure 6:
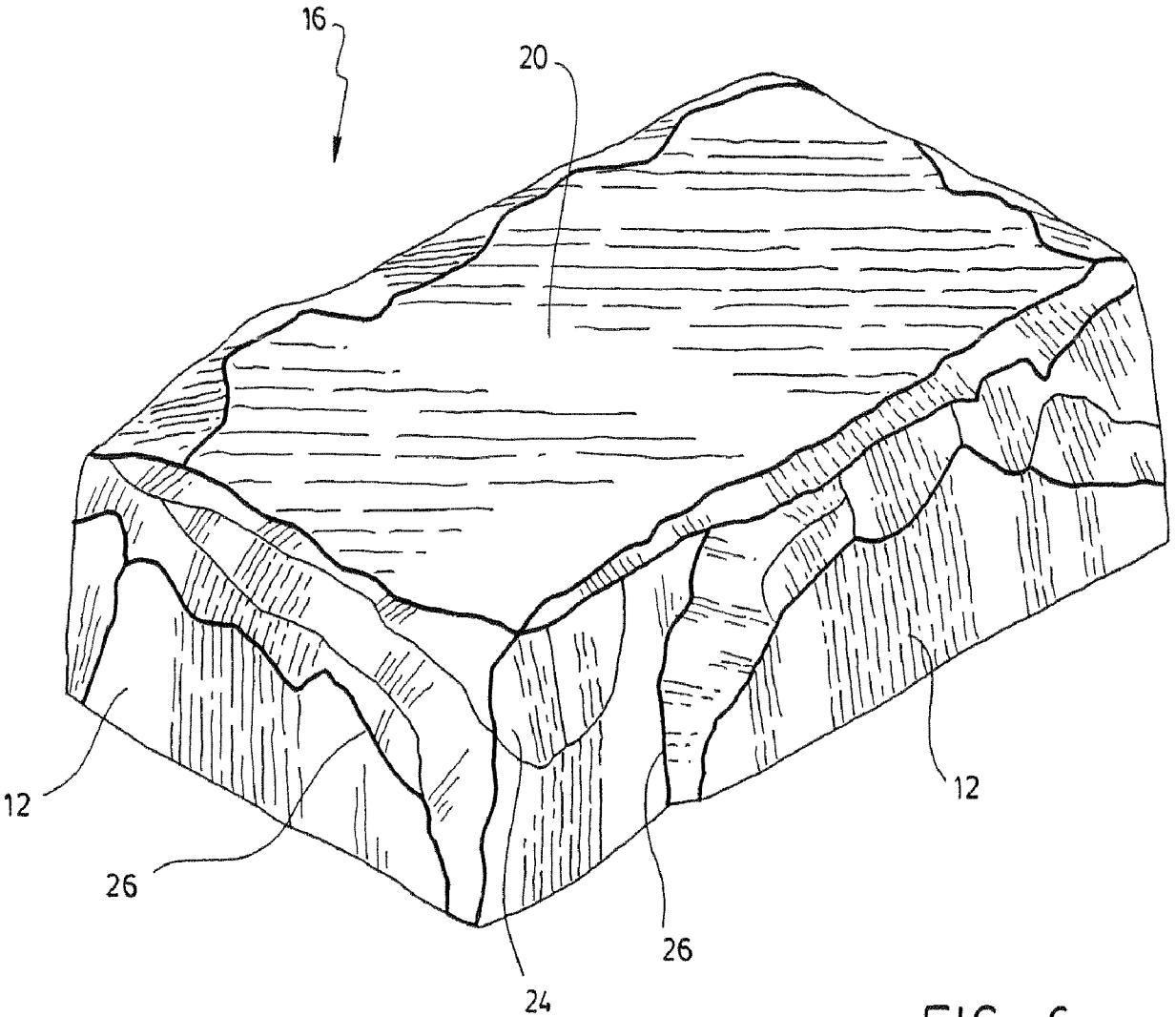
FIG. 6 schematically represents a perspective view of a dry cast stone obtained with the molding apparatus of FIG. 1.

The side walls 6 of the present invention having multilevel surfaces 10 may be used with any suitable molding apparatus known in the art. FIG. 6 shows a molded block 16 formed in a compartment 8 having side walls 6 similar to those illustrated in FIGS. 1 to 5. Block 16 is a dry cast stone produced within a molding frame 2 and has a textured top surface 20 and textured side surfaces 22. The textured top surface 20 is produced by the tamper-shoes 30 used to compact the dry concrete mixture, while the textured side surfaces 22 are mirror images of the multilevel textured surfaces of side walls in accordance with the present invention. It is worth mentioning that tamper shoes with a flat bottom face can be used without departing from the scope of the present invention.

Side surface 22 is given a texture comprising sections 24, imparted by a corresponding multilevel surface 10 comprising corresponding sections 12. As the above-described sections 12 of side wall 6 decreased in thickness, sections 24 of block 16 duly increase in thickness from top to bottom. Further illustrated are transitional curvilinear steps 26 of varying widths which are mirror images of the transitional curvilinear steps 13 of inner wall 6.

It is to be noted again that the expression thickness, when used to describe a section 24 of block 16, relates to the relative nominal thicknesses of discrete portions of block 16 and is not to be measured from an opposing surface 22 which itself is textured and comprises a plurality of sections. In that case as well, an imaginary vertical datum can be established to compare thicknesses. Where side surface 22 is more generally curved, as is within the scope of the present invention, a similar imaginary curved datum can be established.

FIG. 7 shows an edger block 16' obtained with a molding apparatus according to a further preferred embodiment of the present invention. Edger block 16' can be used to line gardens and paths and is therefore often partially buried once installed. As such, edger block 16' is formed of a plurality of sub-blocks 18 which give the appearance of multiple blocks when buried, and comprise a generally flat and non-textured lower portion of surface 22, as is well known in the art.

In order to give a unique appearance to each of the dry cast stones 16, each multilevel surface 10 of the side walls 6 may be custom designed so that they each differ from one another. Therefore, the chance of laying two identical stones next to each other is considerably reduced, even though the set of different stones may be limited. This wide variety of dry cast stones greatly increases the natural appearance of, for example, a low wall or pavement made with the stones 16.

Figure 9:
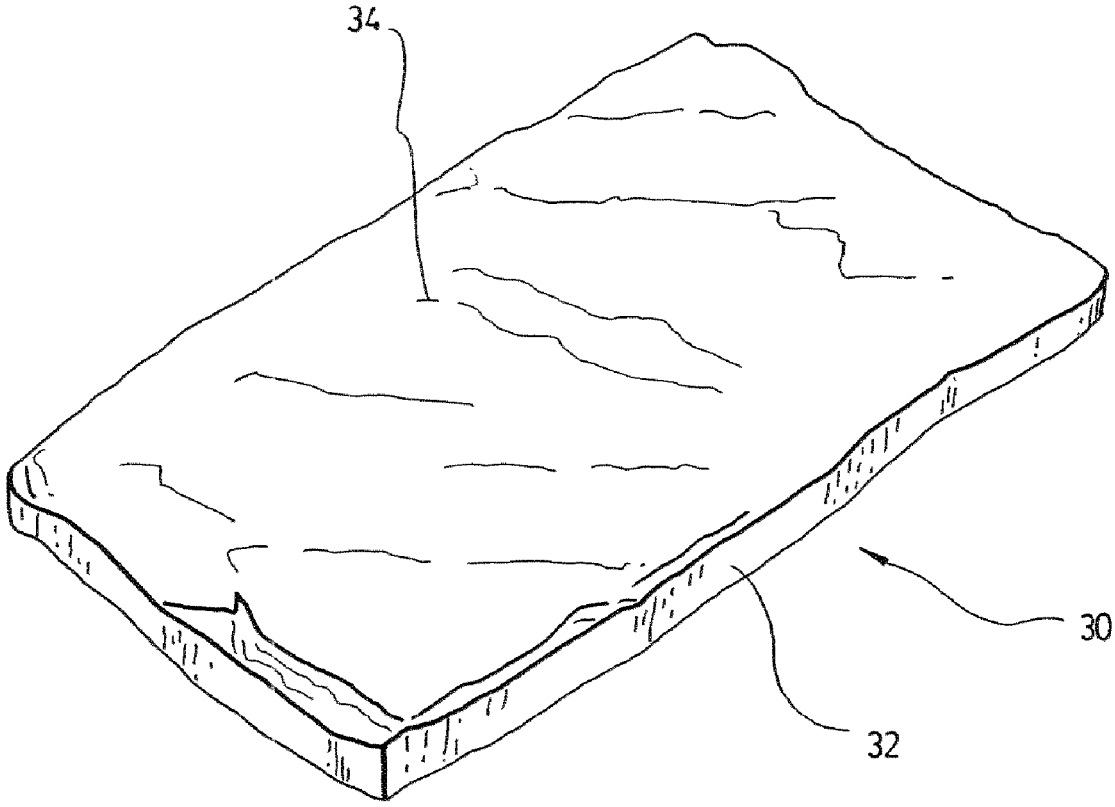
FIG. 9 is a bottom perspective view of the tamper shoe of FIG. 8.

Referring to FIG. 8 and 9, the tamper shoe 30 used for compacting the dry concrete mixture received in the compartment preferably has a contour 32 that matches the non-linear top contour of the open compartment 8. More preferably, the bottom face 34 of the tamper shoe 30 is textured for imparting a textured top surface to the dry cast products. Therefore, the stones made with that preferred embodiment can be textured on all faces or sides, apart from the bottom surface resting on the production plate. The two stems 36 projecting from the top face of the tamper shoe 30 are normally threaded, and, as well known in the art, they are used for mechanically connecting the tamper shoe 30 to a tamper head.

Figure 10:
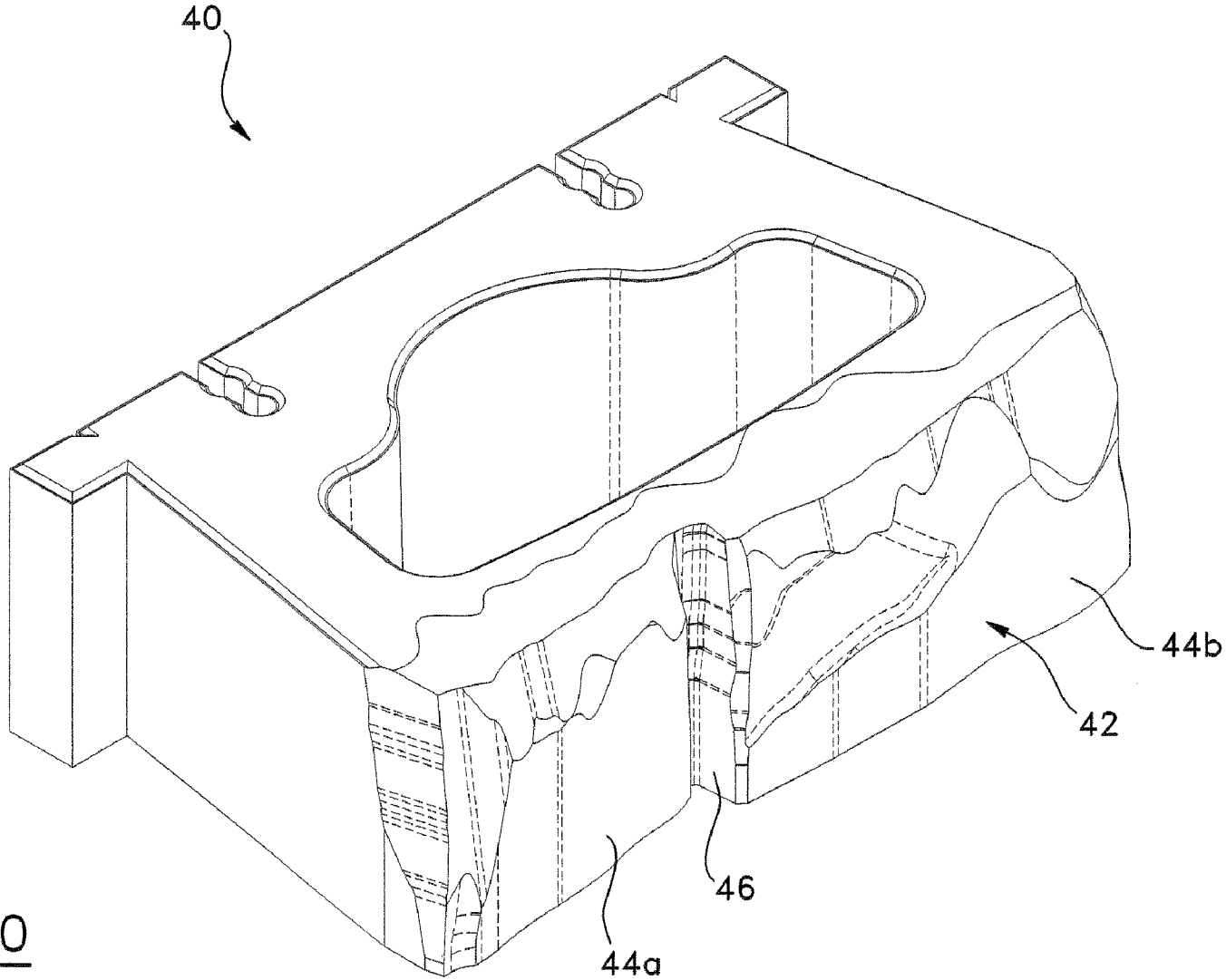
FIG. 10 is a perspective view of a dry cast stone formed in a molding apparatus according to another preferred embodiment of the invention.

FIG. 10 shows a dry cast stone 40 formed in a molding apparatus according to a further preferred embodiment of the invention. In that particular molding apparatus, at least one wall is preferably divided in at least two vertical faces of different thicknesses spanning from top to bottom. Each of these vertical faces is provided with a respective multilevel surface as defined above. These vertical faces are horizontally adjacent to each other and separated by steps extending generally in a vertical direction. Therefore, the dry cast stone shown in FIG. 10 has one side wall 42 divided into two vertical faces 44*a*, 44*b* of different thicknesses spanning from top to bottom. These two vertical faces 44*a*, 44*b* are respectively provided with a multilevel surface and are horizontally adjacent to each other and separated by a step 46 extending generally in a vertical direction. Such a step 46 preferably has a multilevel surface as described above.

In other words, a divided side texture/broken rockface is obtained by the optional use of at least one vertical step 46 in the side face of the mould cavity. This step preferably has a more or less pronounced demoulding angle and also helps induce a differential between the planes of the faces 44*a*, 44*b* (also referred to as subfaces). By using multiple steps 46, it is possible to create the illusion of multiple stones, by having more than one subface 44 on a single side wall 42.

Although the present invention has been explained hereinabove by way of preferred embodiments thereof, it should be pointed out that any modifications to these preferred embodiments within the scope of the appended claims are not deemed to alter or change the nature and scope of the present invention.

What is claimed is:

1. An apparatus for molding dry cast products having a textured side surface, the apparatus comprising:

a) a frame having a plurality of open molding compartments for receiving a dry concrete mixture and removing a dry cast product;

b) each open molding compartment comprising at least four walls laterally enclosing the molding compartment;

c) at least one of the at least four walls comprising a first subface and a second subface, wherein each subface comprises a multilevel surface with a plurality of sections in an overhanging relationship with each other;

d) the plurality of sections comprising:

(i) a top section having a first thickness and comprising a top edge aligned with a top side of the molding compartment, wherein the top side comprises an aperture through which the dry concrete mixture is introduced into the molding compartment;

(ii) a bottom section vertically below the top section and comprising a second thickness smaller than the first thickness and a bottom edge aligned with a bottom side of the molding compartment, wherein the bottom side comprises an aperture through which the dry cast product is removed from the molding compartment; and (iii) transitional curvilinear steps bridging adjacent sections to impart a textured side surface resembling a natural rockface and allowing stripping of the dry cast product from the bottom side of the molding compartment; and e) a step positioned between the first subface and the second subface, wherein the step comprises:

(i) a vertically angled demoulding surface;

(ii) a first vertical edge portion having a vertical profile that substantially conforms to a vertical profile of the first subface; and (iii) a second vertical edge portion having a vertical profile that substantially conforms to the vertical profile of the second subface;

wherein the first vertical edge portion is horizontally offset from the second vertical edge portion, and wherein the vertical profile of the first vertical edge portion has a different shape than the vertical profile of the second vertical edge portion.

2. The apparatus of claim 1, the plurality of sections further comprising:

(iv) at least one intermediate section vertically between the top section and the bottom section, the at least one intermediate section having a respective thickness which is smaller than the first thickness and greater than the second thickness, and the respective thickness the at least one intermediate section decreasing from a topmost to a bottommost of the intermediate section.

3. The apparatus of claim 1, wherein the plurality of sections decrease in overall thickness from the top section to the bottom section.

4. The apparatus of claim 1, wherein the plurality of open molding compartments are arranged in a grid arrangement.

5. The apparatus of claim 1, further comprising:

a tamper shoe for compacting the dry concrete mixture received in the compartment, the tamper shoe having a contour matching a non-linear top contour of the open molding compartment.

6. The apparatus of claim 5, wherein the tamper shoe has a textured bottom face for imparting a textured top surface to the dry cast product.

7. The apparatus of claim 1, wherein at least one of the transitional curvilinear steps follows a line that curves downwards, thereby providing horizontally adjacent sections having different thicknesses within the same subface.

8. The apparatus of claim 7, wherein the line dies at the bottom side.

9. A method for molding dry cast products having a textured side surface, the method comprising the steps of:

a) providing an apparatus as defined in claim 1;

b) pouring a dry concrete mixture within the compartment;

c) compacting the dry concrete mixture against the plurality of walls laterally enclosing the compartment, thereby obtaining a dry cast product; and d) stripping of the dry cast product from the bottom side of the compartment through a vertical relative motion between the dry cast product and the compartment.

10. The method of claim 9, wherein step c) of compacting is performed with a tamper shoe having a textured bottom face thereby providing the dry cast product with a textured top surface.

* * * * *